US009103616B2

(12) United States Patent
Wei

(10) Patent No.: US 9,103,616 B2
(45) Date of Patent: Aug. 11, 2015

(54) DUMP MAGAZINE WITH HIGH CAPACITY

(71) Applicant: Yanwei Wei, Shandong (CN)

(72) Inventor: Yanwei Wei, Shandong (CN)

( * ) Notice: Subject to any disclaimer, the term of this patent is extended or adjusted under 35 U.S.C. 154(b) by 0 days.

(21) Appl. No.: 14/135,504

(22) Filed: Dec. 19, 2013

(65) Prior Publication Data

US 2015/0176936 A1 Jun. 25, 2015

(51) Int. Cl.
*F41A 9/61* (2006.01)
*F41A 9/75* (2006.01)

(52) U.S. Cl.
CPC ..... *F41A 9/75* (2013.01)

(58) Field of Classification Search
CPC ..... F41A 9/75; F41A 9/74; F41A 9/03; F41A 9/73
USPC ..... 42/49.01; 89/33.01, 33.02, 33.1, 33.17
See application file for complete search history.

(56) References Cited

U.S. PATENT DOCUMENTS 1,347,755 A * 7/1920 Payne ..... 42/50
1,368,375 A * 2/1921 Turner ..... 42/50
1,833,431 A * 11/1931 McCormick et al. ..... 42/19
1,867,513 A * 7/1932 Lahti ..... 89/33.02
1,921,871 A * 8/1933 Gaidos ..... 42/50
2,064,888 A * 12/1936 Dickinson ..... 42/6
2,131,412 A * 9/1938 Ostman ..... 42/49.01
4,332,097 A * 6/1982 Taylor, Jr. ..... 42/50
4,745,842 A * 5/1988 Shou-Fu ..... 89/33.02
4,926,742 A * 5/1990 Ma et al. ..... 89/33.02
5,905,224 A * 5/1999 Jordan ..... 89/33.02
8,220,377 B2 * 7/2012 Quetschke et al. ..... 89/33.02
8,733,224 B2 * 5/2014 Lasichak et al. ..... 89/33.02
2011/0005114 A1 * 1/2011 Snow ..... 42/49.01
2011/0107901 A1 * 5/2011 Lasichak et al. ..... 89/33.02
2011/0107902 A1 * 5/2011 Quetschke et al. ..... 89/33.02
2012/0160083 A1 * 6/2012 Rael ..... 89/33.02
2014/0076137 A1 * 3/2014 Lasichak et al. ..... 89/33.02

* cited by examiner

*Primary Examiner* — Samir Abdosh

(57) ABSTRACT

A dump magazine with a high capacity includes: a bullet container for containing bullets, wherein a bullet outlet is provided on said bullet container; a guide provided in said bullet container for forming a spiral tunnel extending to a center of said bullet container for storing bullets; the bullets are filled into said spiral tunnel from said bullet outlet to an end thereof; and a spiral spring device for pushing the bullets towards said bullet outlet, wherein said spiral spring device is mounted aside said guide; a pushing device is mounted on said spiral spring device and extends into said spiral tunnel; when the bullets are filled into said spiral tunnel through said bullet outlet, said pushing device moves along said spiral tunnel in such a manner that said spiral spring device is compressed.

14 Claims, 4 Drawing Sheets

DUMP MAGAZINE WITH HIGH CAPACITY

BACKGROUND OF THE PRESENT INVENTION

1. Field of Invention

The present invention relates to a dump magazine, and more particularly to a dump magazine with a high capacity.

2. Description of Related Arts

The conventional dump magazine has disadvantages in capacity, structure, bullet feeding and suitability. Especially, the bullet feeding is complex and is provided by the mechanical structure of the gun. Thus, not only the mechanical structure is complex, but also the maintenance and the utilization are inconvenient. Besides, the capacity of the conventional dump magazine is low. Meanwhile, because of the mechanical structure of the convenient dump magazine, a huge amount of space is need for satisfying mechanical requirements and the valuable time is wasted. Furthermore, the suitability of the conventional dump magazine is not sufficient due to the firearm principles. That is to say, for utilizing the conventional dump magazine which is not suitable, the gun should be redesigned.

SUMMARY OF THE PRESENT INVENTION

An object of the present invention is to provide a dump magazine with a high capacity for overcoming the above disadvantages.

Another object of the present invention is to provide a dump magazine with a high capacity whose bullet feeding doesn't depend on an external mechanical structure.

Accordingly, in order to accomplish the above objects, the present invention provides a dump magazine with a high capacity, comprising:

a bullet container for containing bullets, wherein a bullet outlet is provided on the bullet container;

a guide provided in the bullet container for forming a spiral tunnel extending to a center of the bullet container for storing bullets; the bullets are filled into the spiral tunnel from the bullet outlet to an end thereof; and a spiral spring device for pushing the bullets towards the bullet outlet, wherein the spiral spring device is mounted aside the guide; a pushing device is mounted on the spiral spring device and extends into the spiral tunnel; when the bullets are filled into the spiral tunnel through the bullet outlet, the pushing device moves along the spiral tunnel in such a manner that the spiral spring device is compressed.

With the foregoing structure, the present invention has advantages as follow:

a) the dump magazine according to the present invention has a simple structure;

b) the capacity of the dump magazine according to the present is more than twice of the conventional dump magazine;

c) the dump magazine according to the present invention is easy to be manufactured; and d) the dump magazine according to the present invention has a strong suitability, wherein the spiral spring utilized has a same principle as a straight springs of convention rifles; as a result, the dump magazine is able to be used by the convention rifles without changing a mechanical structure.

These and other objectives, features, and advantages of the present invention will become apparent from the following detailed description, the accompanying drawings, and the appended claims.

DETAILED DESCRIPTION OF THE PREFERRED EMBODIMENT

Figure 1:
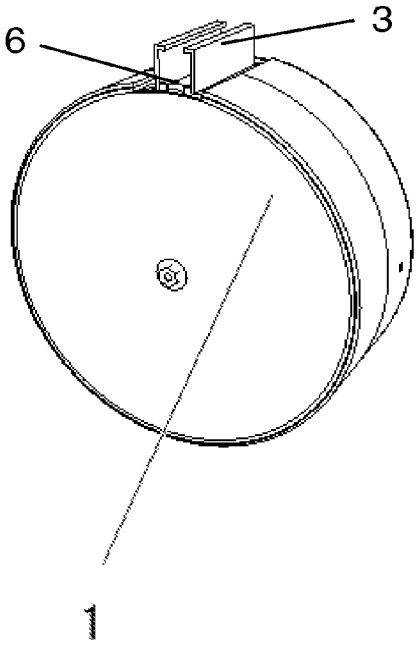
FIG. 1 is a perspective view of a dump magazine according to a preferred embodiment of the present invention.
Figure 2:
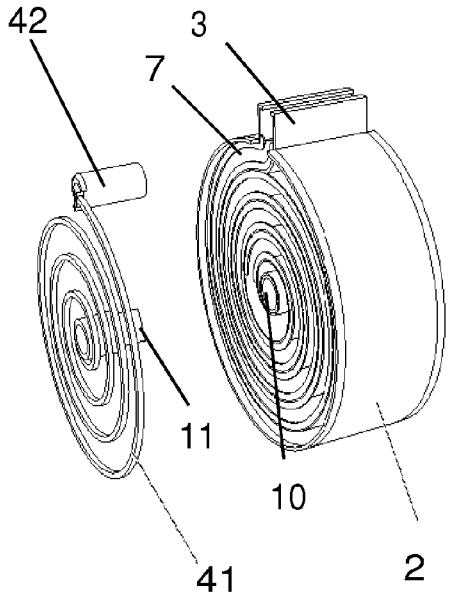
FIG. 2 is a perspective view of a guide and a spiral spring device according to the preferred embodiment of the present invention.
Figure 3:
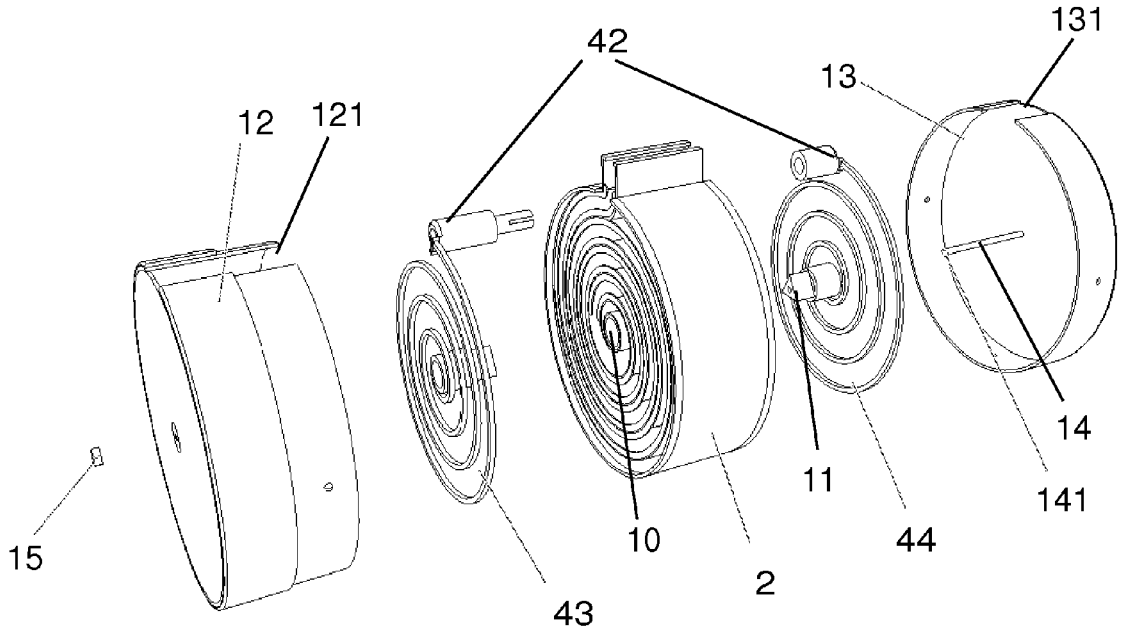
FIG. 3 is an exploded view of the dump magazine according to the preferred embodiment of the present invention.
Figure 4:
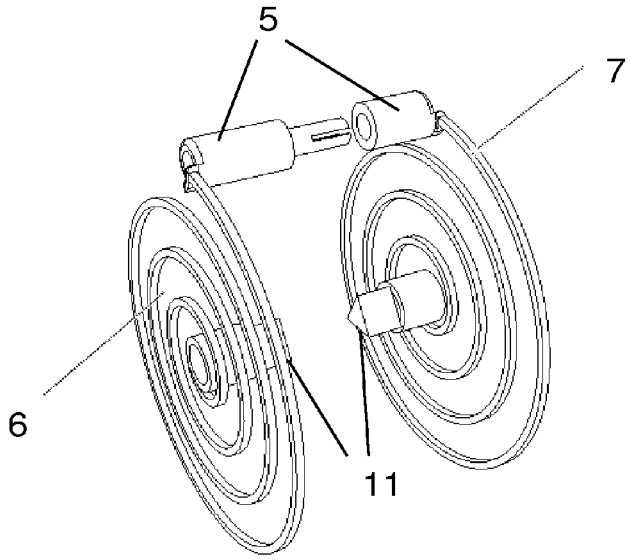
FIG. 4 is a perspective view of a first spiral spring and a second spiral spring according to a preferred embodiment of the present invention.
Figure 5:
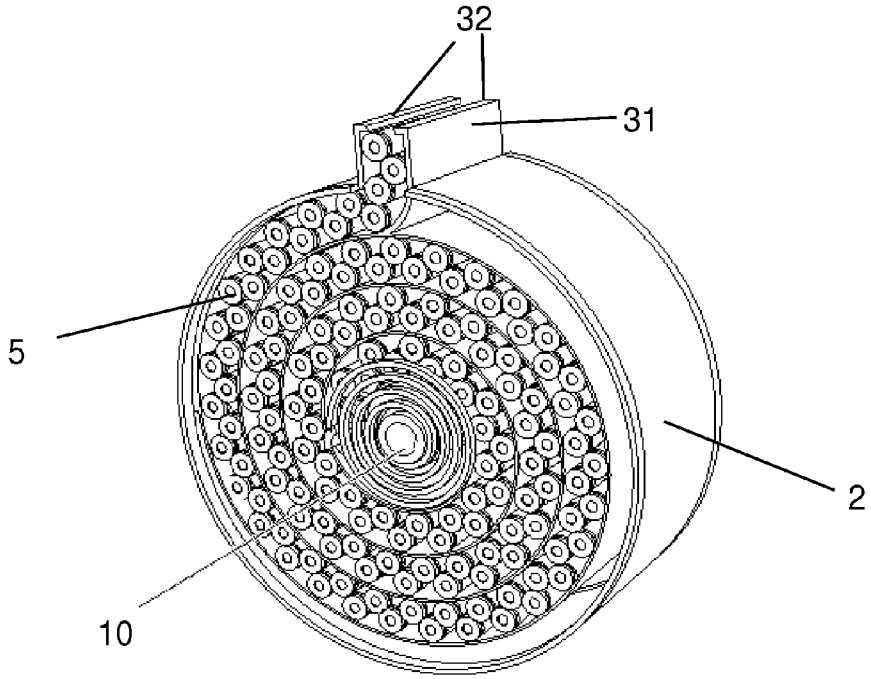
FIG. 5 is a sectional view of the dump magazine filled with bullets according to a preferred embodiment of the present invention.
Figure 6:
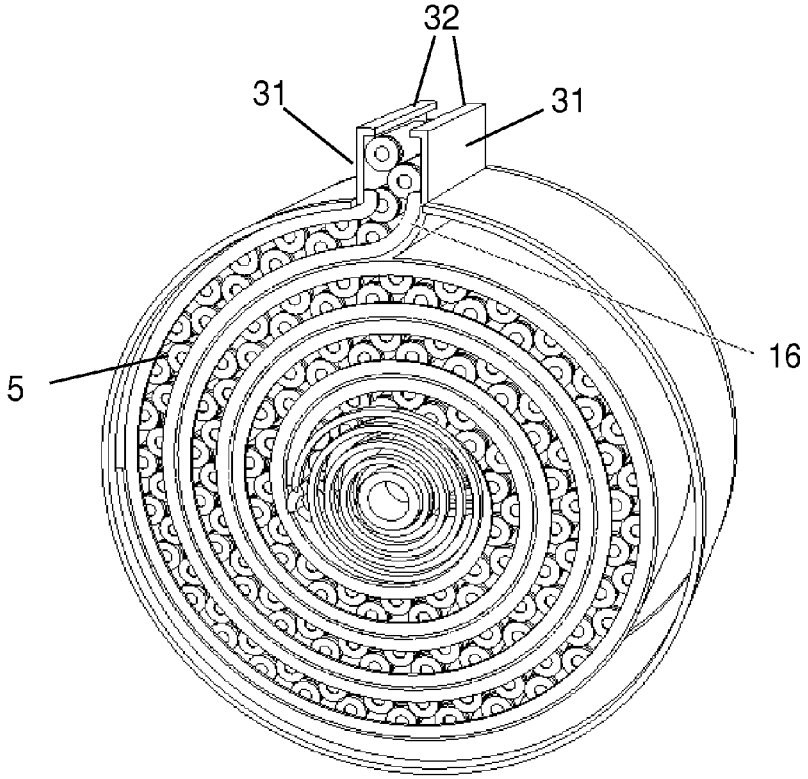
FIG. 6 is a perspective view of a first spiral plate mounted in the dump magazine according to the preferred embodiment of the present invention.
Figure 7:
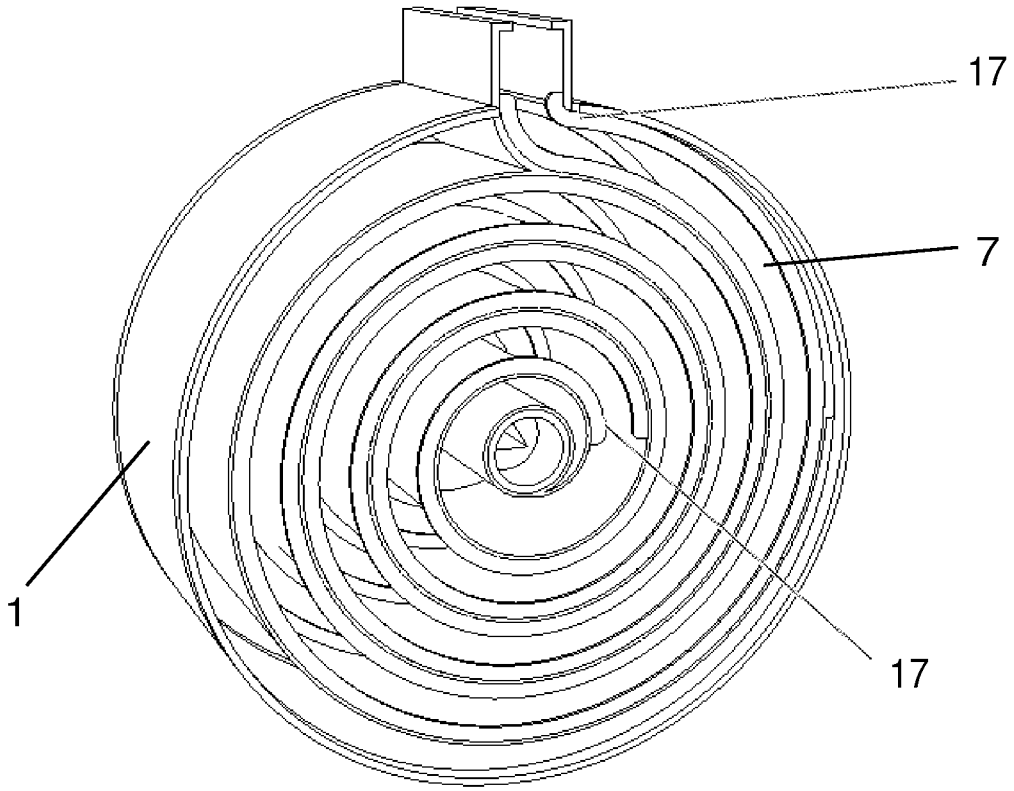
FIG. 7 is a perspective view of a second spiral plate mounted in the dump magazine according to the preferred embodiment of the present invention.

Referring to the drawings, a dump magazine with a high capacity according to a preferred embodiment of the present invention is illustrated, comprising:

a bullet container 1 for containing bullets 5, wherein a bullet outlet 6 is provided on the bullet container 1;

a guide 2 provided in the bullet container 1 for forming a spiral tunnel 7 extending to a center of the bullet container 1 for storing bullets 5; the bullets 5 are filled into the spiral tunnel 7 from the bullet outlet 6 to an end thereof; and a spiral spring device 4 for pushing the bullets 5 towards the bullet outlet 6, wherein the spiral spring device 4 is mounted aside the guide 2; a pushing device is mounted on the spiral spring device 4 and extends into the spiral tunnel 7; when the bullets 5 are filled into the spiral tunnel 7 through the bullet outlet 6, the pushing device moves along the spiral tunnel 7 in such a manner that the spiral spring device 4 is compressed.

With the foregoing structure, the capacity of the dump magazine according to the present is more than twice of the conventional dump magazine. Besides, the dump magazine is easy to be manufactured. Furthermore, the dump magazine has a strong suitability because the spiral spring 41 utilized has a same principle as straight springs of convention rifles. As a result, the dump magazine is able to be used by the convention rifles without changing a mechanical structure.

Preferably, the spiral tunnel 7 fits the bullets 5 in such a manner that the bullets 5 are regularly stored in the bullet container 1 in a spiral strip form and axes of the bullets 5 are parallel to each other.

With the foregoing structure, inner space of the bullet container 1 is fully utilized for storing more bullets 5. And the bullets 5 are distributed more evenly in such a manner that bullet feeding is smoother and the axial hollowed spiral structure is not easy to be worn out.

Preferably, the spiral spring device 4 comprises:

a spiral spring 41 for pushing the bullets 5 towards the bullet outlet 6, wherein a first end of the spiral spring 41 is mounted on a center of the guide 2 in such a manner that the spiral spring 41 is aside of the guide 2;

wherein the pushing device comprises:

a pusher 42 mounted on a second end of the spiral spring 41, wherein the pusher 42 extends into the spiral tunnel 7 and is able to move therealong;

wherein when the bullets 5 are filled through the bullet outlet 6, the pusher 42 is pushed back in such a manner that the spiral spring 41 is winded more tightly until the dump magazine is full; when shooting the bullets 5, the spiral spring 41 in a tightened state drives the pusher 42 for pushing the bullets 5 towards the bullet outlet 6 until all the bullets 5 are shot.

Preferably, the spiral spring device 4 comprises:

a first spiral spring 43 for pushing the bullets 5 towards the bullet outlet 6, wherein a first end of the first spiral spring 43 is mounted on a center of the guide 2 in such a manner that the first spiral spring 43 is at a first side of the guide 2; and a second spiral spring 44 for pushing the bullets 5 towards the bullet outlet 6, wherein a first end of the second spiral spring 44 is mounted on a center of the guide 2 in such a manner that the second spiral spring 44 is at a second side of the guide 2;

wherein the pushing device comprises:

a pusher 42 detachably mounted between a second end of the first spiral spring 43 and a second of the second spiral spring 44, wherein the pusher 42 extends into the spiral tunnel 7 and is able to move therealong;

wherein when the bullets 5 are filled through the bullet outlet 6, the pusher 42 is pushed back in such a manner that the first spiral spring 43 and the second spiral spring 44 are winded more tightly until the dump magazine is full; when shooting the bullets 5, the first spiral spring 43 and the second spiral spring 44 in a tightened state drive the pusher 42 for pushing the bullets 5 towards the bullet outlet 6 until all the bullets 5 are shot.

With the foregoing structure, pressure caused by the bullets 5 is evenly distributed to the first spiral spring 43 and the second spiral spring 44 for stabilizing the whole structure, in such a manner that the dump magazine is more stable when firing, which increases accuracy of continuous fire.

Preferably, a connector 3 is provided on the bullet outlet 6 for loading the dump magazine to a gun, comprising:

two side plates 31 extending outwardly from the bullet outlet 6 for preventing the bullets 5 from radial sliding; and two top plates 32 respectively extending form the two side plates 31 and towards each other for preventing the bullets 5 from being pushed out directly in such a manner that the bullet 5 is stopped in the bullet outlet 6 until being shot by a gun, wherein a distance larger than a caliber of the bullet 5 is provided between the two top plates 32 for putting the bullet 5 in and storing the bullet 5 in a staggered column magazine form.

Preferably, the center of the bullet container 1 has a triangle-shaped hole 10, a triangle-shaped rod 11 is provided on the spiral spring device 4, the spiral device is mounted in the bullet container 1 by inserting the triangle-shaped rod 11 into the triangle-shaped hole 10.

Preferably, the bullet container 1 comprises:

a first shell part 12 having a first opening 121;

a second shell part 13 having a second opening 131, wherein the first shell part 12 cooperates with the second shell part 13 for covering the guide 2, the first spiral spring 43 and the second spiral spring 44; the first opening 121 is corresponding to the second opening 131 in such a manner that the bullet outlet 6 is formed;

a shaft 13, wherein a first end thereof is mounted on a center of the second shell part 13; the guide 2, the spiral spring device 4 and the front shell part have through-holes in such a manner that the shaft 13 passes through and extends outwards from the first shell part 12; a screw thread 141 is provided on a second end of the shaft 13; and a nut 15 engaged with the screw thread 141 for detachably mounting the front shell part with the second shell part 13.

With the foregoing structure, the dump magazine has a similar structure as the conventional magazines. Advantages thereof are that dust is not able to go into the bullet container 1, the bullet feeding is kept smooth, the dump magazine is easy to be manufactured and has a strong suitability, and the dump magazine is able to be used by the convention rifles without changing a mechanical structure.

Preferably, the dump magazine further comprises:

a first spiral plate 16 mounted on the first side of the guide 2, wherein the first spiral plate 16 blocks the spiral tunnel 7 from the first side for preventing the bullets 5 from sliding out from the first side; and a second spiral plate 17 mounted on the second side of the guide 2, wherein the second spiral plate 17 blocks the spiral tunnel 7 from the second side for preventing the bullets 5 from sliding out from the second side.

With the foregoing structure, the bullets 5 are stopped by the spiral plate for preventing the bullets 5 from sliding out from the dump magazine. Furthermore, the dump magazine has a light weight in such a manner that a load of a gunner is decreased.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A dump magazine, comprising:

a bullet container for containing bullets, wherein a bullet outlet is provided on said bullet container;

a guide provided in said bullet container for forming a spiral tunnel extending to a center of said bullet container for storing bullets; the bullets are filled into said spiral tunnel from said bullet outlet to an end thereof; and a spiral spring device for pushing the bullets towards said bullet outlet, wherein said spiral spring device is mounted aside said guide; a pushing device is mounted on said spiral spring device and extends into said spiral tunnel; when the bullets are filled into said spiral tunnel through said bullet outlet, said pushing device moves along said spiral tunnel in such a manner that said spiral spring device is compressed;

wherein said spiral spring device comprises:

a first spiral spring for pushing the bullets towards said bullet outlet, wherein a first end of said first spiral spring is mounted on a center of said guide in such a manner that said first spiral spring is at a first side of said guide; and a second spiral spring for pushing the bullets towards said bullet outlet, wherein a first end of said second spiral spring is mounted on a center of said guide in such a manner that said second spiral spring is at a second side of said guide;

wherein said pushing device comprises:

a pusher detachably mounted between a second end of said first spiral spring and a second of said second spiral spring, wherein said pusher extends into said spiral tunnel and is able to move therealong;

wherein when the bullets are filled through said bullet outlet, said pusher is pushed back in such a manner that said first spiral spring and said second spiral spring are winded more tightly until said dump magazine is full;

when shooting the bullets, said first spiral spring and said second spiral spring in a tightened state drive said pusher for pushing the bullets towards said bullet outlet until all the bullets are shot.

2. The dump magazine, as recited in claim 1, wherein said spiral tunnel fits the bullets in such a manner that the bullets are regularly stored in said bullet container in a spiral strip form and axes of the bullets are parallel to each other.

3. The dump magazine, as recited in claim 1, wherein a connector is provided on said bullet outlet for loading said dump magazine to a gun, comprising:

two side plates extending outwardly from said bullet outlet for preventing the bullets from radial sliding; and two top plates respectively extending form from said two side plates and towards each other for preventing the bullets from being pushed out directly in such a manner that the bullet is stopped in said bullet outlet until being shot by a gun, wherein a distance larger than a caliber of the bullet is provided between said two top plates for putting the bullet in and storing the bullet in a staggered column magazine form.

4. The dump magazine, as recited in claim 1, wherein said center of said bullet container has a triangle-shaped hole, a triangle-shaped rod is provided on said spiral spring device, said spiral device is mounted in said bullet container by inserting said triangle-shaped rod into said triangle-shaped hole.

5. A dump magazine, comprising:

a bullet container for containing bullets, wherein a bullet outlet is provided on said bullet container;

a guide provided in said bullet container for forming a spiral tunnel extending to a center of said bullet container for storing bullets; the bullets are filled into said spiral tunnel from said bullet outlet to an end thereof; and a spiral spring device for pushing the bullets towards said bullet outlet, wherein said spiral spring device is mounted aside said guide; a pushing device is mounted on said spiral spring device and extends into said spiral tunnel; when the bullets are filled into said spiral tunnel through said bullet outlet, said pushing device moves along said spiral tunnel in such a manner that said spiral spring device is compressed;

wherein said bullet container comprises:

a first shell part having a first opening;

a second shell part having a second opening, wherein said first shell part cooperates with said second shell part for covering said guide, a first spiral spring and a second spiral spring; said first opening is corresponding to said second opening in such a manner that said bullet outlet is formed;

a shaft, wherein a first end thereof is mounted on a center of said second shell part; said guide, said spiral spring device and said front shell part have through-holes in such a manner that said shaft passes through and extends outwards from said first shell part; a screw thread is provided on a second end of said shaft; and a nut engaged with said screw thread for detachably mounting said front shell part with said second shell part.

6. The dump magazine, as recited in claim 1, wherein said bullet container comprises:

a first shell part having a first opening;

a second shell part having a second opening, wherein said first shell part cooperates with said second shell part for covering said guide, said first spiral spring and said second spiral spring; said first opening is corresponding to said second opening in such a manner that said bullet outlet is formed;

a shaft, wherein a first end thereof is mounted on a center of said second shell part; said guide, said spiral spring device and said front shell part have through-holes in such a manner that said shaft passes through and extends outwards from said first shell part; a screw thread is provided on a second end of said shaft; and a nut engaged with said screw thread for detachably mounting said front shell part with said second shell part.

7. A dump magazine, comprising:

a bullet container for containing bullets, wherein a bullet outlet is provided on said bullet container;

a guide provided in said bullet container for forming a spiral tunnel extending to a center of said bullet container for storing bullets; the bullets are filled into said spiral tunnel from said bullet outlet to an end thereof;

a spiral spring device for pushing the bullets towards said bullet outlet, wherein said spiral spring device is mounted aside said guide; a pushing device is mounted on said spiral spring device and extends into said spiral tunnel; when the bullets are filled into said spiral tunnel through said bullet outlet, said pushing device moves along said spiral tunnel in such a manner that said spiral spring device is compressed;

a first spiral plate mounted on said first side of said guide, wherein said first spiral plate blocks said spiral tunnel from said first side for preventing the bullets from sliding out from said first side; and a second spiral plate mounted on said second side of said guide, wherein said second spiral plate blocks said spiral tunnel from said second side for preventing the bullets from sliding out from said second side.

8. The dump magazine, as recited in claim 1, further comprising:

a first spiral plate mounted on said first side of said guide, wherein said first spiral plate blocks said spiral tunnel from said first side for preventing the bullets from sliding out from said first side; and a second spiral plate mounted on said second side of said guide, wherein said second spiral plate blocks said spiral tunnel from said second side for preventing the bullets from sliding out from said second side.

9. The dump magazine, as recited in claim 7, wherein said spiral spring device comprises:

a spiral spring for pushing the bullets towards said bullet outlet, wherein a first end of said spiral spring is mounted on a center of said guide in such a manner that said spiral spring is aside of said guide;

wherein said pushing device comprises:

a pusher mounted on a second end of said spiral spring, wherein said pusher extends into said spiral tunnel and is able to move therealong;

wherein when the bullets are filled through said bullet outlet, said pusher is pushed back in such a manner that said spiral spring is winded more tightly until said dump magazine is full; when shooting the bullets, said spiral spring in a tightened state drives said pusher for pushing the bullets towards said bullet outlet until all the bullets are shot.

10. The dump magazine, as recited in claim 2, wherein a connector is provided on said bullet outlet for loading said dump magazine to a gun, comprising:

two side plates extending outwardly from said bullet outlet for preventing the bullets from radial sliding; and two top plates respectively extending from said two side plates and towards each other for preventing the bullets from being pushed out directly in such a manner that the bullet is stopped in said bullet outlet until being shot by a gun, wherein a distance larger than a caliber of the bullet is provided between said two top plates for putting the bullet in and storing the bullet in a staggered column magazine form.

11. The dump magazine, as recited in claim 2, wherein said center of said bullet container has a triangle-shaped hole, a triangle-shaped rod is provided on said spiral spring device, said spiral device is mounted in said bullet container by inserting said triangle-shaped rod into said triangle-shaped hole.

12. The dump magazine, as recited in claim 9, wherein said spiral tunnel fits the bullets in such a manner that the bullets are regularly stored in said bullet container in a spiral strip form and axes of the bullets are parallel to each other.

13. The dump magazine, as recited in claim 9, wherein a connector is provided on said bullet outlet for loading said dump magazine to a gun, comprising:

two side plates extending outwardly from said bullet outlet for preventing the bullets from radial sliding; and two top plates respectively extending from said two side plates and towards each other for preventing the bullets from being pushed out directly in such a manner that the bullet is stopped in said bullet outlet until being shot by a gun, wherein a distance larger than a caliber of the bullet is provided between said two top plates for putting the bullet in and storing the bullet in a staggered column magazine form.

14. The dump magazine, as recited in claim 9, wherein said center of said bullet container has a triangle-shaped hole, a triangle-shaped rod is provided on said spiral spring device, said spiral device is mounted in said bullet container by inserting said triangle-shaped rod into said triangle-shaped hole.

* * * * *